United States Patent [19]

Ditcher et al.

[11] Patent Number: 4,737,220

[45] Date of Patent: Apr. 12, 1988

[54] METHOD OF MAKING A MANHOLE RISER HAVING INTEGRAL FLEXIBLE WATERLOCK FOR MANHOLE COVERS AND HAVING A WATER TIGHT SEAL FOR SEALED MANHOLE COVERS

[75] Inventors: Jack Ditcher, Langhorne; Eric Ditcher, Bensalem; James A. Westhoff, Langhorne, all of Pa.

[73] Assignee: A-Lok Products, Inc., Tullytown, Pa.

[21] Appl. No.: 890,139

[22] Filed: Jul. 28, 1986

Related U.S. Application Data

[62] Division of Ser. No. 779,845, Sep. 25, 1985, Pat. No. 4,621,941.

[51] Int. Cl.[4] ..... B29C 53/00; B29C 65/00; E02D 29/14

[52] U.S. Cl. ..... 156/218; 52/20; 156/158; 156/217; 156/258; 264/148; 264/248; 277/207 A; 404/25; 404/26

[58] Field of Search ..... 156/217, 218, 158, 258, 156/304.5, 503; 277/207 A; 264/248, 148; 52/20; 404/25, 26

[56] References Cited

U.S. PATENT DOCUMENTS

| | | | |
|---|---|---|---|
| 2,772,719 | 12/1956 | Wills | 156/258 |
| 4,279,676 | 7/1981 | Morrison et al. | 156/258 |
| 4,337,005 | 6/1982 | LeBaron | 404/26 |
| 4,394,024 | 7/1983 | Delhaes | 277/207 A |
| 4,510,664 | 4/1985 | Lock | 156/218 X |
| 4,540,310 | 9/1985 | Ditcher et al. | 52/20 X |

*Primary Examiner*—Donald E. Czaja
*Assistant Examiner*—Jeff H. Aftergut
*Attorney, Agent, or Firm*—Louis Weinstein

[57] ABSTRACT

A hollow, flexible, bendable, cylindrical-shaped, hat-like sleeve is water-tightly joined with the upper end of the riser section of a manhole structure. The free end of the sleeve is trimmed so that its upper edge fits beneath the shoulder of the frame supporting the manhole cover to prevent subsurface water from entering into the manhole interior through the regions between the manhole cover supporting frame and the top of the riser section, which is usually fitted with adjustment rings to bring the manhole cover frame up to grade. The sleeve is easily cut to any height to accommodate either a greater or lesser number of height adjustment rings. The sleeve flange is cast into the riser section. The sleeve may be folded into itself to significantly lower its profile to expedite handling, transportation and assembly. A plastic clamping band may be placed into the interior of the sleeve to water-tightly join the upper end of the sleeve to the manhole cover support frame.

11 Claims, 3 Drawing Sheets

FIG. 1
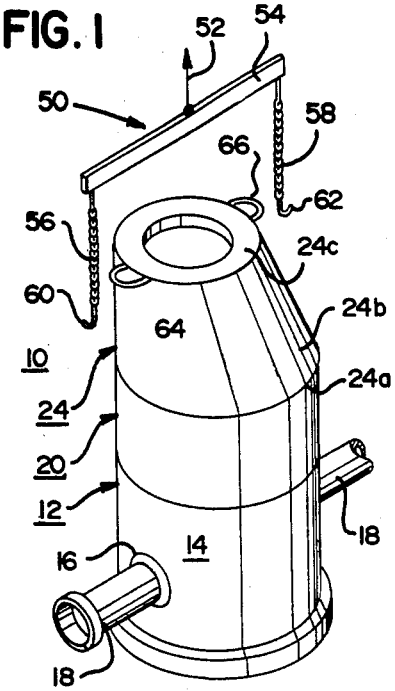
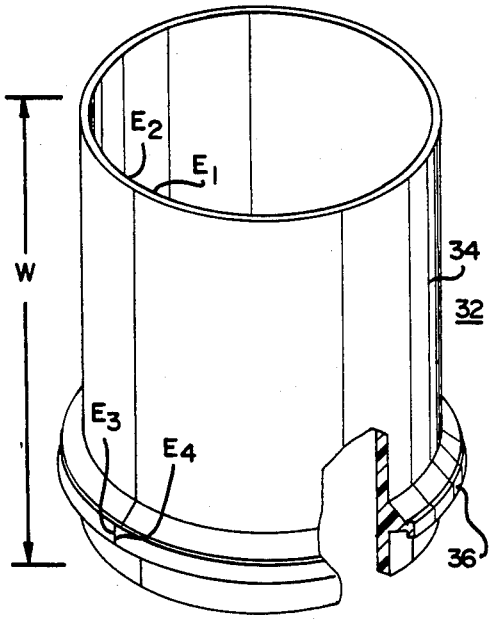
FIG. 3
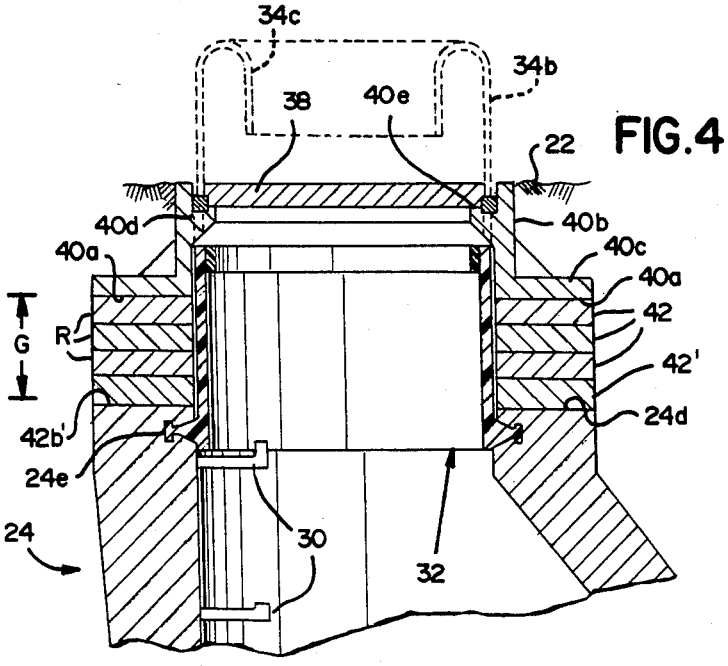
FIG. 4

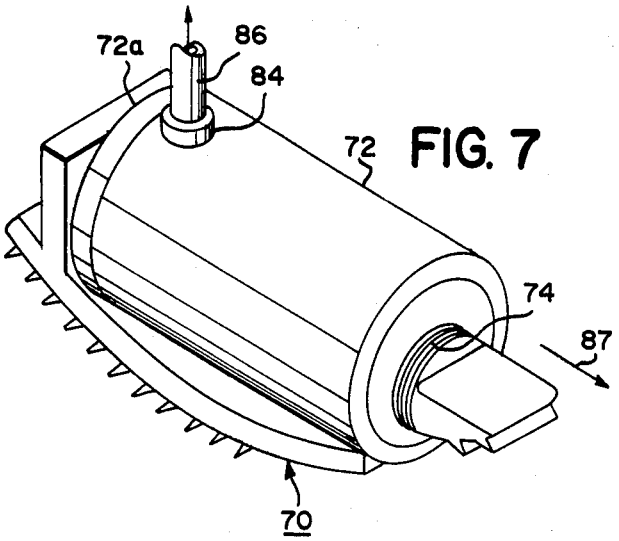
FIG. 7
FIG. 6
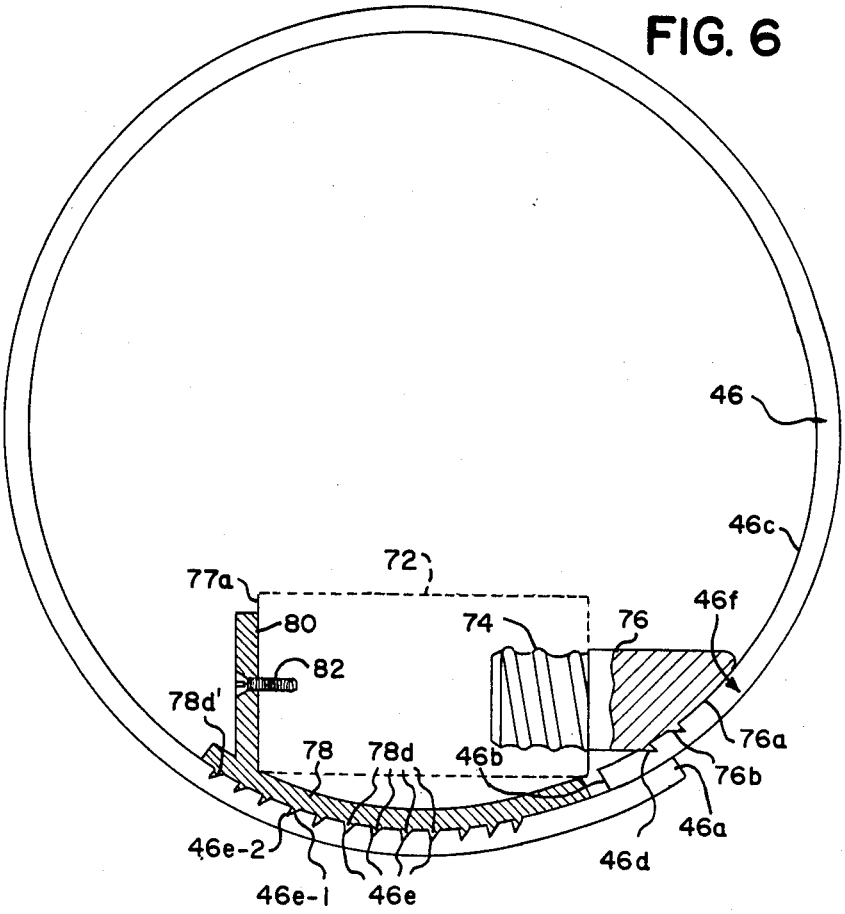

METHOD OF MAKING A MANHOLE RISER HAVING INTEGRAL FLEXIBLE WATERLOCK FOR MANHOLE COVERS AND HAVING A WATER TIGHT SEAL FOR SEALED MANHOLE COVERS

The present invention application is a division of parent application Ser. No. 779,845, filed Sept. 25, 1985, now U.S. Pat. No. 4,621,941, issued Nov. 11, 1986.

FIELD OF THE INVENTION

The present invention relates to apparatus for providing water-tight manhole structures, and more particularly, to a novel combination manhole riser section and integral, resilient, foldable, plastic sleeve for preventing subsurface water from entering into the interior of a manhole structure by gaining access thereto in the region between the manhole cover support frame and the top of the riser selection.

BACKGROUND OF THE INVENTION

Manhole structures are arranged at predetermined intervals along sewage lines, for example, for inspection and cleaning purposes, and for providing an intersection between two branches of a sewer line merging into a third, to name just a few applications.

A manhole structure is typically comprised of a manhole base, an intermediate section and a top riser section. The manhole base is placed beneath grade at a depth dependent upon the depth of the sewer line entering the base, through an opening made water-tight by a cooperating gasket. The intermediate and riser sections are utilized to bring the manhole structure up to grade, and provide a water-free, hollow interior which may be easily entered for repair and/or maintenance. The open top of the manhole structure is sealed with a manhole cover removably supported upon a supporting frame, said frame resting either directly upon the top of the riser section or upon the top surface of a grade adjustment ring which may, for example, be one of a plurality of grade adjustment rings positioned between the top surface of the riser section and the bottom surface of the manhole cover support frame, in order to bring the frame opening supporting the manhole cover up to grade.

In order to prevent subsurface water from entering into the interior of the manhole structure through the region of the engaging surfaces between the manhole cover and the adjustment rings, and/or between the engaging surfaces of adjacent adjustment rings, and/or between the engaging surface of an adjustment ring and the top surface of the riser section, mortar is placed between these engaging surfaces. However, due to irregularities in the engaging surfaces; shrinkage and dynamic loading, natural erosion and deterioration of the mortar due to frost heave, surface water eventually seeps through the above-mentioned regions to enter into the interior of the manhole structure.

It is further desirable to install manhole structures in such a way as to limit on-site activities to a minimum and it is, therefore, desirable, not only to provide a water-tight seal in the region between the manhole riser section and the manhole cover support frame, but to be able to accomplish this through the use of a manhole structure, which is of simplified design and is easy to install and does not require additional, complicated manual activity at the installation site.

One technique for accomplishing the above results is described in copending application Ser. No. 514,584 filed July 18, 1983 which discloses a riser section incorporating an integral plastic sleeve, having a flange cast into the riser section. The height of the sleeve is sufficient to accommodate rather large adjustment gaps between the manhole cover supporting frame and the top of the riser section and is preferably formed of a plastic material which, although having excellent ability to withstand erosion and/or deterioration over a long period of time, is easy to cut, in order to position the trimmed cut edge of the free end of the sleeve immediately beneath the shoulder of the manhole cover support frame.

The method for installing the apparatus of the abovementioned copending application is as follows:

The manhole base, intermediate and riser sections are installed into the ground using conventional techniques and such that the aforementioned plastic sleeve, whose flange is cast into the top region of riser section extends upwardly and above the top surface of the riser section and has an outer diameter which is slightly less than the inner diameter at the open upper end of the riser section.

Dependent upon the depth of the top surface of the riser section relative to grade, none, one or more than one grade adjustment ring is positioned upon the top surface of the riser section. If desired, mortar is placed in the regions between the engaging faces of said members.

The distance between the top surface of the riser section and the interior shoulder of the manhole cover supporting frame is determined, and the top portion of the free end of the sleeve is removed by a simple cutting operation, to locate the top edge of the sleeve just beneath the aforesaid shoulder of the manhole cover supporting frame, thereby completing the installation operation. Since the sleeve providing the water-tight capability is cast into the riser section at the factory, no positioning and/or securement of the sleeve to the riser section is necessary, thus greatly simplifying installation. The sleeve prevents water from entering into the interior of the manhole structure.

The disadvantage of the plastic sleeve disclosed in the aforementioned copending application Ser. No. 514,584 is that the sleeve is easily damaged or broken during handling and especially during transportation, rendering the sleeve, and hence the riser section, useless.

It is further important to provide manhole assemblies having a manhole cover which is water-tightly sealed, an arrangement that is especially useful in low-lying areas which are frequently subjected to flooding. It is not possible to provide the waterlock arrangement of aforementioned Application Ser. No. 514,584 with a water-tight manhole cover.

BRIEF DESCRIPTION OF THE INVENTION

The present invention is characterized by comprising a manhole assembly riser section with a waterlock member integrally cast into the riser section. The waterlock member comprises a cylindrical portion having an annular flange at the lower end which flange is imbedded into the riser section.

The waterlock member is resilient, and even foldable, being formed of a material such as EPDM, rubber or a rubber-like material. The resilient material enables the waterlock member to yield under pressure during handling transportation and installation. The sleeve is readily and easily trimmed to the proper height with a knife or other suitable cutting instrument. The waterlock member is preferably formed by an extruding process which greatly facilitates and simplifies manufacture and the attendent costs. The extrusion process is employed to extrude an elongated, sheet-like member of indeterminate length having a continuous projection provided along one major surface and adjacent one edge thereof. The projection has a radially extending portion with tapered contour, narrowing to a reduced thickness and thereafter abruptly widening, forming an axially extending anchoring section comprised of a flange forming a T-shaped cross-section with the radially extending tapered projection. The waterlock member is formed by cutting the extruded section to a predetermined length according to the diameter desired for the waterlock member.

The ends of the cut section are joined to one another by a vulcanization process or by an adhesive or solvent which fuses the edges being joined to form a hollow cylindrical member having a continuous substantially T-shaped projection extending outwardly from the exterior surface of the waterlock member. The tapered portion prevents the projection from folding over due to being forced to assume an increased length when the extruded sheet is arranged in annular fashion.

The resiliency of the waterlock member enables the sleeve portion to be compressed against a grade ring or manhole cover support to provide a completely water-tight manhole assembly which is especially advantageous in areas subjected to frequent flooding. The gasket is compressed against the encircling member by a clamping band which is expanded into the sleeve and locked into the expanded position to expand the sleeve outwardly and against the surrounding enclosure and holds the sleeve compressed between the clamping band and surrounding enclosure to provide an excellent water-tight seal.

OBJECTS OF THE INVENTION AND BRIEF DESCRIPTION OF THE DRAWINGS

It is, therefore, one object of the present invention to provide a novel combination riser section and sleeve integrally cast therewith, for use in manhole structures to prevent subsurface water in the region between the manhole cover support frame and the riser section from entering into the interior of the manhold structure.

Still another object of the present invention is to provide a water-tight sleeve of the character described, wherein the sleeve comprises a cylindrical sleeve portion having a integral flange at its lower end which is integrally cast into the riser section.

Still another object of the present invention is to provide a combination riser section and sleeve of the character described, wherein the sleeve is formed of a resilient material capable of withstanding erosion and/or deterioration due to the exposure to sewage and/or subsurface water and the like, and yet which is easily trimmed with a simple cutting tool, such as a knife, to facilitate simple and rapid adjustment of the height of the sleeve relative to the top of the riser section will provide the desired water-tight protection.

Still another object of the present invention is to provide a novel combination riser section having an resilient sleeve which is integrally cast into the riser section and is yieldable to a degree sufficient to bend and even be folded into itself to avoid being damaged during fabrication, transportation, installation and other related handling.

Still another object of the present invention is to provide a novel resilient yieldable waterlock member which is integrally cast into a riser section and which is capable of being both stretched and compressed to provide a water-tight seal with a expanded clamping band arranged within a manhole cover support frame to provide a water-tight manhole assembly.

Still another object of the present invention is to provide a novel resilient, yieldable, foldable waterlock member for use with riser sections and the like and which is formed of an extruding process and has a projection thereon with a cross-sectional configuration which prevents the projection from folding over on itself when bent into a cylindrical shape to form the waterlock member.

The above, as well as other objects of the present invention will become apparent when reading the accompanying description and drawing in which:

FIG. 1 shows a perspective view of a manhole structure, which may utilize the sleeve of the present invention to great advantage.

FIG. 3 shows a perspective view, partially sectionalized, of the sleeve employed in the embodiment of FIGS. 2 and 4.

FIG. 4 shows another alternative manhole installation employing the sleeve of FIG. 3.

FIG. 6 shows an end view of the clamping band showing in FIG. 4.

FIG. 7 shows a side view expansion jack for expanding the clamping band of FIG. 6.

DETAILED DESCRIPTION OF THE INVENTION

Figure 2:
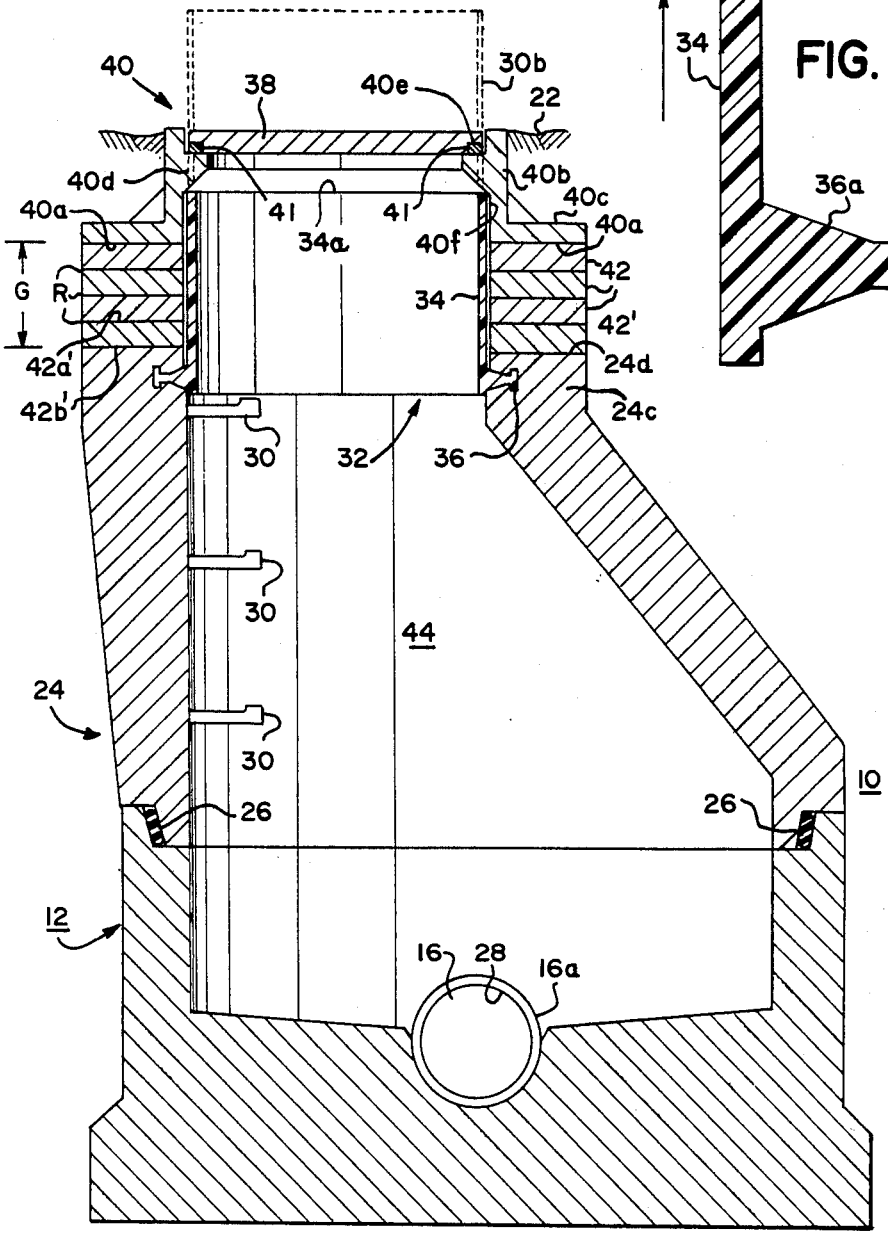
FIG. 2 shows a sectional view of a manhole structure embodying the sleeve of the present invention.

FIG. 1 shows a conventional manhole structure 10 embodying the principles of the present invention and comprised of a base 12 having openings 16 in its cylindrical side wall 14 for receiving a pipe, such as pipes 18, 18' which may, for example, be sewer pipes. Base 12 is located at a predetermined distance below surface 22 (FIG. 2) to assure that the manhole base and the end of pipe 18 (and/or 18') entering opening 16 are both at the proper depth below grade.

An intermediate section 20 is arranged upon base 14, and a gasket is typically utilized between the mating surfaces via the water-tight seal. Riser section 24 is shown arranged upon intermediate section 20, and a gasket is typically utilized between the mating surfaces to provide a water-tight seal. The riser section has a lower portion **24*a* of greater diameter to properly mate with the upper surface of intermediate section 20. The upper section 24*b* of the riser 24 is tapered, forming an upper end 24*c*, which properly mates with the manhole cover support frame 40 and/or grade rings 42 (see FIG. 2**), as the case may be.

FIG. 2 shows a manhole structure 10, which is modified relative to the manhole structure 10 of FIG. 1, in that intermediate section 20 has been omitted for purposes of simplicity. FIG. 2 shows the mating surfaces provided at the top end of base 12 and the bottom end of riser section portion **24*a* to assure that the riser section is properly seated upon base 12. A continuous annular gasket 26 is arranged between the diagonally-aligned mating surfaces and is under compression. Riser section 24 is seated on base 12. It should be understood that the intermediate section 20 mates with the base 12 and riser section 24 in a similar manner. Depending upon the particulars at the location of base 12, intermediate section 12** may or may not be needed.

Opening 16, which receives a pipe, is provided with an annular resilient gasket 28, which provides a water-tight seal between the exterior surface of the pipe 18 and the wall 16*a*, defining the opening 16 in manhole base sidewall 14.

The U-shaped steps 30 are cast into the straight wall of riser section 24 to facilitate the entry and egress of an operator in manhole structure 10.

The resilient, yieldable, foldable plastic sleeve 32, shown also in FIG. 3, which is utilized to provide the water-tight seal, is comprised of an elongated cylindrical sleeve portion 34, having an outwardly extending integral flange 36 near its bottom end. In the embodiment shown in FIG. 2, flange 36 is integrally cast into the upper portion 24*c* of riser section 24. Flange 36 (see FIG. 5) is integrally jointed to sidewall 34 and comprises a tapered projection 36*a* terminating in a planar portion 36*b* forming a substantially T-shaped projection 36, which is imbedded in the upper portion 24*c* of riser section 24.

In order to locate the manhole cover 38 at grade, i.e., substantially co-planar with road or ground surface 22, it is typically necessary to build up the gap space G between the top surface 24*d* of riser section 24 and the bottom surface 40*a* of manhole support frame 40, with one or a plurality of grade adjustment rings 42.

Frame 40 is preferably formed of cast iron and has a cylindrical-shaped central portion 40*b*. The lower end is joined to an integral outwardly directed flange 40*c*, having bottom supporting surface 40*a*. An inwardly directed flange 40*d* forms supporting shoulder 40*e*, which serves to support manhole cover 38, as shown. To make the manhole cover assembly water-tight, a resilient annular gasket 41 may be arranged between surface 40*e* and manhole cover 38. The gasket 41 may be imbedded in the flange 40*d* or in the manhole cover 38, if desired.

Grade rings 42 are circular-shaped discs of finite thickness and have flat upper and lower mounting surfaces. Note, for example, bottom-most grade ring 42', which has upper surface 42*a'* and lower surface 42*b'*. Lower surface 42*b'* may engage the supporting surface 24*d* of a riser section 24, or may engage the top surface of an adjacent grade ring 42. The top surface 42*a'* of grade ring 42' may engage the bottom surface of the next adjacent grade ring thereabove, or may engage the bottom surface 40*a* of support frame 40. Mortar is preferably arranged in the regions R between the aforesaid engaging surfaces.

Installation of the structure 10 is performed as follows:

The base 12, intermediate 20, and riser 24 sections are installed using conventional techniques, the intermediate section 20 being either utilized or omitted dependent upon the depth of the base section 12 relative to grade. The riser section 24 incorporates integral water-tight sleeve 32. Mortar is placed upon the lower surface of each engaging region R and the number of grade rings 42 (and 42') required to bring the manhole cover 38 substantially into co-planar alignment with grade 22, are mounted one atop the other. The top portion of sleeve 34 is trimmed by a conventional cutting tool such as, for example, a knife, to bring the top-most edge just beneath the diagonally aligned surface of shoulder 40*d*, as shown in FIG. 2. The removed portion 34*b* is shown in dotted fashion. The sleeve 34 is of a thickness sufficient to withstand deterioration and yet thin enough to facilitate the trimming operation. The thickness of sleeve 34 is preferably in the range from 0.15 to 0.35 inches and preferably 0.23 to 0.27 inches.

Even assuming that any subsurface water is capable of penetrating through the regions R in the gap G between manhole cover frame 40 and the top surface 24*d* of riser section 24, sleeve 32 prevents subsurface water reaching the exterior surface of sleeve 34 from entering into the interior 44 of manhole structure 10. It can be seen that the installation is quite simple and straightforward, the only additional step required at the jobsite being the trimming of the top portion 34*b* of sleeve 34, which is a simple and straightforward operation requiring no special tools.

Riser sections 24 are quite heavy and are typically moved from one place to another by means of a lifting assembly 50 shown in FIG. 1 and comprised of a cable 52 coupled to a crane, hoist or other suitable device. The lower end of cable 52 is coupled to arm 54 having chains 56 and 58 suspended from opposite ends thereof. Hooks 60 and 62 are arranged at the lower ends of chains 56 and 58 and are adapted to be hooked upon the lift members 64 and 66 imbedded into riser section 24. The assembly is lowered sufficiently to align hooks 60 and 62 with lift members 64 and 66. The crane or hoist is then lifted to lift the riser section off the ground. When the lifting assembly 50 is lowered into position, the assembly quite frequently collides or otherwise makes engagement with the sleeve portion 34, deflecting it significantly away from its normal position. Impacts and collisions of this nature cause conventional waterlock members, for example, as described in co-pending Application Ser. No. 514,584, filed July 18, 1983 and assigned to the assignee of the present application, to become cracked and/or broken and both the waterlock member and the riser section are thus rendered totally useless.

Due to the fact that the upper end of the waterlock member 32 extends significantly above the top surface 24*c* of riser section 24 (see FIGS. 2 and 4), the waterlock sleeve 34 is susceptible to being engaged and bent in a variety of different ways. As another example, when transporting riser sections on open bed trucks, low clearance objects (i.e. bridges, tunnels, etc.) will cause the riser sections to be deflected or bent. As was mentioned hereinabove, conventional rigid sleeves break under such conditions. The novel sleeve of the present invention being formed of a material such as EPDM, a rubber of other rubber-like material, is freely yieldable and is capable of yielding and/or bending due to such handling and capable of returning to their original shape upon release of such bending forces. In addition to bending and yielding freely in the presence of such forces and/or objects, the sleeve may be folded inwardly upon itself in the manner shown in FIG. 4 wherein the top-most portion 34*c* of sleeve 34 is pushed into the intermediate portion so that the top-most portion is folded over, as shown in dotted fashion in FIG. 4. The sleeve 34 may be folded in this manner to avoid unnecessary collisions with surrounding objects during fabrication, handling, transportation or installation. Upon use, the top-most portion 35*c* is simply pulled out of the intermediate portion and the gasket simply resumes its normal cylindrical configuration. The material forming the water lock member is chosen to make the water lock member sufficiently resilient to undergo such folding and bending without any loss in resiliency.

Figure 5:
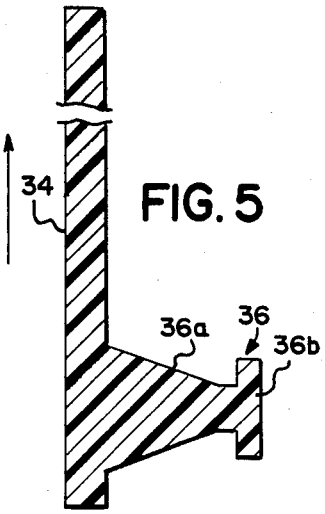
FIG. 5 shows a sectional view of an extruded member used to form the sleeve of FIG. 3.

The waterlock member 32 is preferably formed by an extrusion process utilizing extruding equipment (not shown) for forming an extruded product, shown in FIGS. 3 and 5, which is comprised of an elongated, sheet-like portion 34 of a predetermined width W (see FIG. 3) and being extruded to form a sheet of indeterminate length measured in the direction perpendicular to the width of the sheet. The extrusion process simultaneously extrudes or forms the integral projection 36 described hereinabove and which is comprised of tapered portion 36*a* having its greatest thickness at the surface 34*a* of sheet 34 and tapering to a narrower thickness where it joins a flat sheet-like portion 36*b* integral with tapering portion 36*a* and forming a substantially T-shaped projection.

The waterlock member 32 is formed in the following manner:

Based upon the diameter of the desired waterlock member, a length of the extruded sheet is cut to form a cylindrical sleeve 34 of the desired diameter. The sheet is then bent or curved in such a manner as to bring the free ends E1 and E2 (see FIG. 3) into engagement to define a cylindrical-shape sleeve 34. The free ends E3 and E4 of the T-shaped projection 36 are also brought together in a similar fashion to form the ring-shaped projection 36 extending outwardly from the outer periphery of sleeve portion 34. The ends to be joined are treated with a binding agent and are then subjected to heat and pressure within a joining assembly to form a vulcanized splice. The splice may also be formed as an injection splice wherein material in the liquid state, and which is the same as or similar to the material of the extruded member is injected between the ends to be joined and the ends are heated as they are pressed together. Alternatively, a suitable adhesive or solvent may be utilized to join the free ends E1–E2 and E3–E4 with the junction which is formed being of equal strength to that of the remaining portion of the waterlock member.

The waterlock member is then mounted within a mold assembly (not shown) employed for casting the riser section 24. The casting material, typically reenforced concrete, is poured into the mold and fills the mold assembly, completely surrounding projection 36. After the cast material is set, the riser section is removed from the mold assembly yielding a riser section 24 having an integral waterlock member 32. The T-shaped cross-section 36 serves to firmly retain the waterlock member within the riser section.

The tapered portion 36*a* of the T-shaped projection prevents section 36*a*, as well as the outer portion 36*b* of the T-shaped projection, from folding over due to the internal forces of the extruded member when the extruded member is bent and hence longitudinally stretched into the cylindrical configuration shown in FIG. 3. The aforementioned forces result from the fact that, although the length of portion 36*b* is equal in length to the length of the sheet portion 34, when the extruded member is folded in to the shape shown in FIG. 3, the circumference along the outer surface of portion 36*b* is measureably greater than the circumference of the external surface of the sleeve portion 34. This is also true of the projection 36. Although the aforementioned forces would normally tend to urge the portion 36*a* to fold over upon itself, by using the tapered configuration as shown, the tapered projection prevents such folding over from occuring, thereby yielding a stable waterlock member 32.

The waterlock member of the present invention is extremely useful for applications in which it is desirable to provide a water-tight manhole assembly. Such applications include, for example, the installation of manhole assemblies in low-lying areas which are subject to frequent flooding. In order to prevent surface water, which is accumulated during flooding, from entering the manhole assembly, the manhole assembly must be rendered water-tight. As was mentioned hereinabove, one step which must be undertaken is the provision of a resilient compressible gasket 41 between the surface 40*e* of flange 40*d* and the marginal portion of the underside of manhole 38. Gasket 41 may either be imbedded in a suitable recess provided in surface 40*e* or may be imbedded within a like recess provided along the underside of manhole cover 38 adjacent the periphery thereof. However, this water-tight seal will not prevent surface water which has precolated into the ground from entering into the interior 44 of the manhole assembly. To assure complete water-tightness of the manhole assembly, an expandable clamping band 46 (see FIG. 4) is placed inside of the upper end of sleeve 34 and is expanded outwardly, preferably by a hydraulic means to be more fully described hereinbelow, to urge the upper portion of sleeve 34 against the inner periphery 40*f* of the manhole cover support frame 40. Clamping band 46 remains locked within the interior of sleeve 34 whose compressed portion exerts a force upon clamping band 46 so that it is retained in the locked position.

Clamping band 46 and the apparatus utilized for its expansion is shown in FIGS. 6 and 7.

Clamping band 46 is a substantially annular member formed in a generally circular shape of a plastic material substantially impervious to corrosive influences normally encountered in sewage systems and arranged to be positioned to engage the inner periphery of sleeve 34. The clamping band 46 is premolded into a substantially ring-shaped member having a discontinuity to form two separated ends 46*a* and 46*b*. The inner periphery 46*c* is provided with a plurality of notches 46*e* each having a diagonally aligned portion 46*e*-1 and a perpendicularly aligned portion 46*e*-2, relative to inner periphery 46*c*.

A portion of the inner periphery 46*c* adjacent end 46*b* is provided with triangular-shaped notches 46*d* similar to notches 46*e*. Notches 46*e* and 46*d* cooperate with the expansion jack of FIG. 7 in a manner to be more fully described to faciliate expansion of clamping band 46.

An expansion jack 70 shown in FIG. 7 is utilized to expand gasket 46 to its clamping position in a manner to be more fully described and is comprised of expansion jack housing 72 which houses a piston (not shown) for reciprocating movement. A piston rod 74 is joined to the aforesaid piston and its free end is welded to the left-hand end of a pusher member 76 having a surface 76*a* provided with projections 76*b* for engagement with notches 46*d*. A curved plate 78 has an integral projection 80 joined to the left-hand end 72*a* of housing 72 by fastening means 82. Surface 78*a* of curved plate 78 is provided with projections 78*b* which engage selected ones of the notches 46*e*. Coupling 84 is coupled to a hydraulic pump unit (not shown for purposes of simplicity), through flexible conduit 86 to urge piston rod 74 to the right as shown by arrow 87.

Air under pressure is introduced into housing 72 through coupling 84 which may be coupled to a manually operated hydraulic pump which may be automatic or may be pumped either by hand or by foot to introduce hydraulic pressure into expansion jack 72 and thereby drive piston rod 74 outwardly to move pusher arm 76 relative to plate 78.

The manner in which the expansion band is inserted and clamped is as follows:

The ends 46*a* and 46*b* of clamping band 46 are placed in overlapping fashion so that end 46*a* lies outside of end 46*b*. The ends 46*a* and 46*b* are drawn apart an amount sufficient to reduce the outer diameter of clamping band 46 to enable the clamping band 46 to be inserted within the interior of sleeve 34 in the position generally as shown in FIG. 4. The clamping band is placed adjacent to the upper end of sleeve 34 as shown in FIG. 4. The expansion jack 70 is placed into the interior of clamping band 46 so that surface projection 76*b* of pusher 76 engage notches 46*d* and so that projections 78*d* of plate 78 engage selected ones of the notches 46*e*. Tooth 78*d'* is preferably longer than the remaining teeth 78.

With the expansion jack 70 aligned in the manner described, fluid pressure is introduced into the expansion jack housing 72 urging piston rod 74 outwardly, thereby causing pusher arm 76 to move away from plate 78, causing the ends 46*a* and 46*b* of clamping band 46 to be moved closer and closer together.

The application of fluid pressure continues until ends 46*a* and 46*b* are slightly separated from one another, whereupon end 46*b* snaps outwardly and downwardly relative to end 46*a* so that these ends are now positioned adjacent to one another. The pressure from the hydraulic jack is then relieved, enabling ends 46*a* and 46*b* of clamping band 46 to engage one another due to the tendency of the portion of compressible sleeve 34 arranged between clamping band 46 and the inner periphery of manhole cover support frame 40 to assume its normal thickness, the sleeve 34 having been both slightly expanded by clamping band 46 and compressed between clamping band 46 and the manhole cover support frame 40. Clamping band 46 is retained in this position, assuring a permanently locked condition and providing a water-tight seal between manhole cover support frame 40 and completely preventing riser section 24, thus rendering the entire structure water-tight and the ingress of water which frequently may occur during flooding conditions.

The arrangement described herein thus prevents any water which may seep between riser section 24 and grade rings 42 or between grade rings 42 and manhole cover support frame 40 from entering the manhole assembly 10, thus providing a structure whose integrity is excellent, insofar as water-tightness is concerned.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method for forming a sleeve means for use in providing a water-tight seal in the region above riser sections of a manhole structure and between the top riser section and a manhole cover support frame, said method comprising the steps of:

extruding a sheet of predetermined thickness and width and of indeterminate length and having an integral projection extending from one major surface thereof, said integral projection being formed to have a substantially T-shaped cross-section;

providing the portion of said projection having said T-shaped cross-section which is integrally joined to said sheet with a tapered configuration such that the wider end of said taper is integrally joined to said sheet and the projection tapers to a predetermined thickness to define opposing surfaces which are substantially planar, the end of said tapered portion remote from said sheet abruptly extending outwardly on either side of said tapered projection, thereby forming said T-shaped cross-section;

the opposing surfaces of the tapered portion of said projection being formed to define angles with the plane of said sheet which are substantially equal;

cutting the extruded member transverse to the length thereof to provide a section of predetermined length;

bending the section and bringing the two free ends of said cut portion into engagement with one another to form a cylindrical shape; and joining said ends to thereby form a continuous cylindrical-shaped sleeve having a continuous projection extending about the exterior of said sleeve, wherein the tapered portion of said projection prevents said projection from folding over on itself upon longitudinal expansion of the length of said projection due to the extruded member being formed into a combined cylindrical sleeve having an annular integral continuous projection.

2. The method of claim 1 wherein the extruding step further comprises the step of locating the projection a spaced distance inwardly from one of the longitudinal sides of said sheet.

3. The method of claim 1, wherein said extruded member is formed of a material selected from the group consisting of neoprene, polyisoprene, EPDM, natural rubber and a rubber like sythetic material having the properties of natural rubber.

4. The method of claim 1, wherein said joining step further comprises joining said ends through the use of a material selected from the group consisting of an adhesive, a glue, an epoxy, and a solvent.

5. The method of claim 1, wherein said joining step further comprises joining said ends through the use of vulcanizing process.

6. The method of claim 5, wherein a binding agent is applied to the ends being joined during the vulcanizing process.

7. The method of claim 5, wherein the vulcanizing process includes applying heat and pressure to the ends of the sleeve being joined.

8. The method of claim 5, wherein said vulcanizing process includes injecting a material between said joined ends, said material being vulcanized to said ends.

9. The method of claim 1 further comprising the steps of:

mounting the sleeve within a mold assembly for casting a riser section; and pouring casting material into the mold to fill the mold assembly and completely surround the T-shaped projection.

10. The method of claim 9 further comprising the step of removing the riser section from the mold after the cast material is set.

11. The method of claim 9 further comprising the step of folding the top end of the sleeve downwardly and into itself to reduce the overall height of the combined riser and integrally joined sleeve.

* * * * *